United States Patent [19]

Furtwaengler et al.

[11] Patent Number: 4,951,016

[45] Date of Patent: Aug. 21, 1990

[54] POLARIZED ELECTROMAGNETIC MULTI-CONTACT RELAY

[75] Inventors: Gerhard Furtwaengler, Unterhaching; Ulrich Kobler, Wessling; Heinz Stadler, Munich; Josef Weiser, Hohenschaeftlarn, all of Fed. Rep. of Germany

[73] Assignee: Siemens Aktiengesellschaft, Berlin & Munich, Fed. Rep. of Germany

[21] Appl. No.: 328,958

[22] Filed: Mar. 27, 1989

[30] Foreign Application Priority Data

Mar. 25, 1988 [DE] Fed. Rep. of Germany ..... 3810226

[51] Int. Cl.[5] ..... H01H 51/22

[52] U.S. Cl. ..... 335/80; 335/78; 335/81

[58] Field of Search ..... 335/78, 79, 80, 81–85, 335/106, 107, 128

[56] References Cited

U.S. PATENT DOCUMENTS

| | | | |
|---|---|---|---|
| 4,206,432 | 6/1970 | Altorfer et al. | 335/106 |
| 4,311,976 | 1/1982 | Sauer et al. . | |
| 4,577,172 | 3/1986 | Schedele et al. . | |
| 4,577,173 | 3/1986 | Schedele et al. . | |

OTHER PUBLICATIONS

Helmut Schedele et al., "The Miniature Relay P1, A Highly Sensitive Ultra-Compact Relay", pp. 137–142, 8229 Siemens Components, 21(1986) Aug., No. 4, Berlin, Germany, Siemens Components XXI (1986), No. 4.

*Primary Examiner*—Leo P. Picard
*Assistant Examiner*—Lincoln Donovan
*Attorney, Agent, or Firm*—Hill, Van Santen, Steadman & Simpson

[57] ABSTRACT

A relay includes a coil member having two through extending contact spaces parallel to the axis of the coil member. The contact tongues are arranged in the contact spaces and are anchored in common in a first coil flange to form working air gaps with pole pieces in the region of a second coil flange. The pole pieces are arranged in pairs and lie perpendicularly in a plane at an end face of the second coil flange. A permanent magnet arrangement having a plurality of magnetic poles corresponding to twice the number of pole pieces polarized the pole pieces. The permanent magnet poles facing away from the pole pieces are coupled to the bearing side of the contact tongues via flux guidance plates. The permanent magnet regions allow individual independent balancing of each and every pole piece to achieve synchronous switching of the two contact tongues.

16 Claims, 3 Drawing Sheets

POLARIZED ELECTROMAGNETIC MULTI-CONTACT RELAY

BACKGROUND OF THE INVENTION

1. Field of the Invention

The present invention is related generally to a polarized electromagnetic relay, and more particularly to a relay including a coil member carrying an excitation winding and having two coil flanges and at least one axially extending through cavity. At least two armature contact tongues are arranged inside the coil member essentially parallel to the axis thereof, the armature contact tongues being seated at one side of the coil member in region of a first of the coil flanges. A plurality of stationary, cooperating contact elements serve as pole pieces and correspond in number to the number of contact tongues. The cooperating contact elements are in a region of a second of the coil flanges and are arranged opposite one another in respective pairs. The pairs of contact elements enclose a free end of corresponding ones of the contact tongues between them thereby forming working air gaps. A permanent magnet arrangement to which the pole pieces are coupled is provided so that the pole pieces of each and every pair are oppositely polarized.

2. Description of the Related Art

A relay of the foregoing type is disclosed, for example, in German published application No. DE-A-29 31 409. The relay includes two contact tongues and the contact tongues are seated in common in a coil flange in an exemplary embodiment therein and, as such, have their principle planes in one plane next to one another. The pole pieces are also arranged in pairs in a plane parallel to the plane of the contact tongues. A common, two-pole permanent magnet serves as a pre-magnetization means for both pole piece pairs. After the through-connection of a contact tongue, there is a risk that the magnetic circuit will close via this through-connected tongue and that the electromagnetic excitation is no longer sufficient under certain circumstances for switching the second contact unit. Additional measures are therefore provided in the known relay to improve synchronous switching of both contact tongues. For example, both contact tongues are enveloped with a common plastic part for the purpose of parallel guidance. Moreover, to fix the pole pieces in their respective, common plane, the pole pieces are additionally already enveloped in common before assembly. All of these measures require additional work steps and materials yet completely synchronous switching is nonetheless not guaranteed because of the unavoidable tolerances or variations.

SUMMARY OF THE INVENTION

An object of the present invention is to provide a relay of the foregoing type which includes two or, under given conditions, more contact units in the coil member, whereby the individual contact tongues and pole pieces are structurally mounted independently of one another in simple way, but whereby a high reliability of synchronous switching is achieved for all switch units. In the present relay, the response values for the switch units are adjustable by adjustment or balancing, and even for compensating tolerances as warranted.

This and other objects of the invention are achieved in that the contact tongues have their principle planes residing perpendicular to the connecting plane of the relay in planes parallel to one another. The pole pieces are essentially flat and are arranged next to one another in a common plane perpendicular to the connecting plane of the relay and to the planes of the contact tongues at the end face of the coil member at the second coil flange. The permanent magnet arrangement for every pole shoe comprises a separate polarization region having a polarization direction parallel to the coil axis, whereby one pole with a pole piece and the opposite pole facing away from the pole piece is coupled via a flux plate to the appertaining contact tongue in the region of the first coil flange, being coupled thereto in every polarization region.

By arranging the contact tongues in planes that are perpendicular to the connecting plane of the relay and that are parallel to one another, a ratio of width to height of the coil member is achieved which is favorable with the switching units lying next to one another. In this way, moreover, all pole pieces lie next to one another and are perpendicular to an end face of the coil member. The pole pieces have their terminals directly in the same plane extending in a downward direction. An advantage is realized both in the manufacture of the parts as well as the assembly thereof. Moreover, this arrangement is beneficial for coupling of the permanent magnet arrangement as well as for magnetization and balancing thereof.

The permanent magnet arrangement, which is expediently formed with a single cuboid or plate-shaped permanent magnet, has a separate pole pair for every pole piece in accordance with the invention. Thus, an eight-poled magnet is used for two switchover contacts having four pole pieces. The permanent magnet poles facing away from the pole pieces are coupled to the bearing location of the contact tongues in the region of the opposite coil flange via one or more flux plates. Since every pole piece comprises a separate permanent magnet region, the individual permanent magnet regions can also be separately balanced so that manufacturing tolerances or variations in materials and in the assembly spacings are compensated by correspondingly different magnetization of the permanent magnet regions. In this way, thus, the response values of the individual armature contact units are separately set and are matched to one another so that a synchronous switching or, as needed, an intentionally different switch behavior is set.

To improve the insulation between the individual contact units, the coil member also comprises an axially through extending contact space for every contact tongue. The individual contact spaces are at least partially separated from one another by a partition lying parallel to the axis. The partition, or for more than two contact units, the partitions, also increase the stability of the coil member. Moreover, a cavity is provided in the partition in some embodiments and the cavity serves, first, to save on material and to guarantee a uniform thickness of material and, second, is capable of accepting, for example, a getter tablet or an auxiliary component part, as needed. In some embodiments, the partition is formed by a getter foil or sheet so that the getter tablet is omitted.

As mentioned, the flux return from the permanent magnet poles lying at the outside to the fixing points of the contact tongues ensues via a common flux plate which may also be formed as a ferromagnetic cap. Alternately, the flux return may be through separate flux plates for every contact unit. The pole pieces themselves are expediently respectively positioned between ribs at the end face of the coil member and, preferably, their contact region comprises contact pieces bent slightly out of their principle plane in the direction of the contact tongue. The fastening ribs of the pole pieces expediently correspond in thickness to the thickness of the pole pieces, so that a largely planar seating surface is present for the permanent magnet arrangement. A plastic film for insulation and for preliminary sealing is thereby expediently provided, such as, for example, by being bonded on between the pole pieces and the permanent magnet. A corresponding insulating film is also expediently provided at the opposite coil member flange between the contact tongue ends and the flux plate or plates. The overall coil member unit together with the inserted pole pieces and the emplaced permanent magnet as well as the flux guidance plates are expediently embedded in plastic in a cap or in molded plastic. The pole pieces and the permanent magnet are thereby also finally fixed. The aforementioned balancing of the permanent magnet regions can subsequently ensue in a known way. As mentioned, each of the perpendicularly residing pole pieces comprises proceeding extensions as terminal elements. For special applications, however, it is also provided that two neighboring pole pieces are joined to one another and are of one piece and do not comprise a separate terminal element. For example, the through-connection of two normally closed contacts can thus be already provided in the relay without the necessity of an external contact, as is occasionally required in, for instance, telephone systems.

The fastening and adjustment of the contact tongues ensues, for example, in a known way according to German published application DE-A-33 38 198 and corresponding U.S. Pat. No. 4,577,172, incorporated herein by reference, in that the contact tongues have a fastening end comprising T-shaped, applied fastening tabs glued in wedge-shaped grooves in the coil member and aligned during gluing in the manner set forth therein.

DESCRIPTION OF THE PREFERRED EMBODIMENTS

Figure 1:
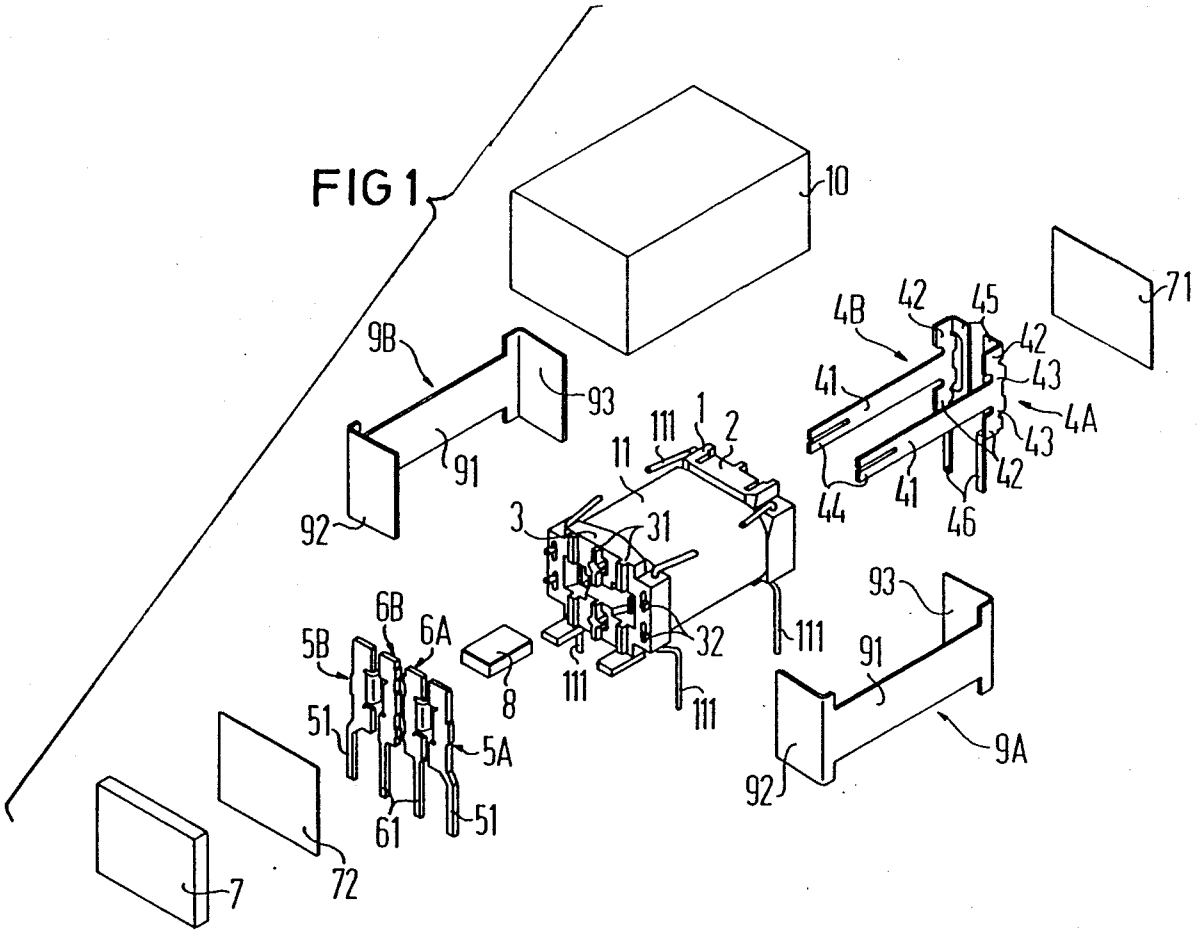
FIG. 1 is an exploded perspective view of the parts of a relay according to the principles of the present invention.
Figure 2:
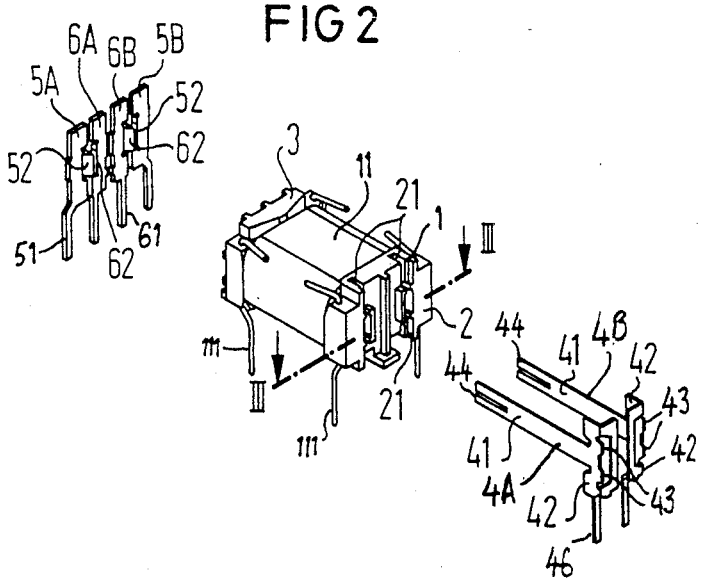
FIG. 2 is an exploded perspective view of the present coil member turned relative to FIG. 1 to show the contact tongues and the pole plates.
Figure 3:
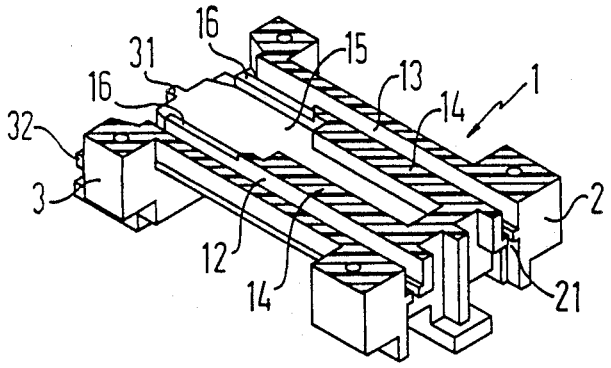
FIG. 3 is a cross section in perspective along line III—III of the coil member of FIG. 2.

A relay is shown in FIGS. 1, 2 and 3 for mounting on a surface, such as a circuit board. In the illustrated example, the surface on which the mounted relay rests is a connecting plane. The relay includes a coil member 1 having an excitation winding 11 applied between two coil flange members 2 and 3. It is also contemplated to provide two excitation windings in an alternate embodiment. The coil member 1 comprises two parallel, through contact spaces 12 and 13 (see FIG. 3) extending in a direction parallel to the axis of the coil member 1. The contact spaces 12 and 13 are at least partially separated from one another by one or more partitions 14 proceeding entirely or partially through the coil member in a longitudinal direction. A cavity 15 is provided in the partition 14 or, when several are present, in the region of the partitions 14. First, this saves on the material during manufacturing of the coil member 1. Second, the cavity 15 serves to guarantee the dimensional accuracy of the coil member 1 during manufacture such as, for example, during injection molding, by guaranteeing approximately uniform material thickness. Further, the cavity 15 accepts, for example, a getter element 8 as shown in FIG. 1. In this case, passages 16 are provided between the cavity 15 and the two contact spaces 12 and 13 to allow the getter element 8 to take effect.

Proceeding from the side of the relay at the coil flange member 2, two armature contact elements 4A and 4B are inserted into the two contact spaces 12 and 13. The two armature contact elements 4A and 4B are formed and arranged as mirror images of one another. Each of the two armature contact elements 4A and 4B comprise a contact tongue 41 and a respective cut-free fastening tab 42 at both sides of the fastening end thereof in the region by which the contact elements 4A and 4B are fixed. The contact tongues 41 lie parallel to one another and are perpendicular to the connecting plane of the relay. The fastening tabs 42 are connected by a torsion ridge 43 to the respective contact tongue 41. The fastening tabs 42 are inserted into bearing grooves 21 in the flange member 2 and are preferably glued thereto. While the glue is hardening, the contact tongue 41 may be adjusted toward the center or toward one side, as disclosed, for example, in German published application DE-A-33 38 198 and corresponding U.S. Pat. No. 4,577,172, incorporated herein by reference, or in earlier German Patent No. P 35 43 099.0.

Four pole pieces are arranged at the end face of the second coil flange 3. In particular, the pole pieces 5A and 5B as well as 6A and 6B are formed in pairs as mirror images of one another. All pole pieces 5A through 6B are essentially formed as planar plates that are arranged in a plane perpendicular to the connecting plane of the relay and also perpendicular to the axis of the coil 11. The pole pieces are respectively clamped between salient ribs 31 and lugs, or noses, 32 of the coil flange member 3. The heights of the ribs 31 and lugs 32 is of a dimension corresponding approximately to the thickness of the pole pieces 5A, 5B, 6A or 6B so that a flush, substantially flat faces is provided thereby. In a downward direction, the pole pieces 5A through 6B comprise applied terminal pins 51 and 61. Moreover, two pole pieces 5A and 6A enclose a free end 44 of a contact tongue between them, and similarly, two pole pieces 5B and 6B enclose a free end 44 of the other contact tongue 41 between them. In the region of the contact tongue end 44, the pole shoes 5A, 5B, 6A and 6B comprise somewhat cut-free contact pieces 52 or 62 which are slightly bent in a inward direction to provide each with a contact surface 53 or 63 that lies parallel to the surface of the appertaining contact tongue 41 (see FIG. 4).

After assembly of the pole pieces 5A, 5B, 6A and 68, as well as of the armature contact elements 4A and 4B, the coil member 1 is provisionally closed by two insulating films or foils 71 and 72 as shown in FIG. 1. The insulating films 71 and 72 are applied to the end faces and are possibly bonded on. After bonding of the insulating films, a permanent magnet 7 is put in place on an outside surface of the pole pieces 5A through 6B over the insulating film 72. Two flux guidance plates 9A and 9B are then laterally applied or pushed over the coil member 1. A respective middle section 91 of the flux guidance plates lies laterally next to the winding 11 with a first leg 92 covering two of the pole plates 5A and 6A or, respectively, 5B and 6B and an opposite leg 93 resting on an angled flux transition part 45 of the respective armature contact element, over the insulating film 71.

The relay arrangement made in this way, which, however, is not yet fixed in terms of all of its parts, is placed into a cap 10 so that only the terminal pins 51 and 61 of the pole pieces as well as the terminal pins 46 of the armature contact elements 4A and 4B and coil terminal pins 111 anchored in the coil flanges 2 and 3 project therefrom. The cap 10, which is composed of plastic, is then filled with a casting compound to pot or embed the relay so that all parts are fixed relative to one another. The films 71 and 72 prevent the casting compound from flowing into the interior of the contact spaces 12 and 13. Subsequently, the permanent magnet can still be magnetized and balanced in the desired fashion, as shall be set forth later with reference to FIG. 4. The plastic cap can also be removed when the relay is potted or the relay can be extrusion coated in a form.

Instead of the two U-shaped flux plates 9A and 9B, a single U-shaped flux guidance plate can also be used, which connects all pole pieces to the two bearing ends of the armature contact elements and, for example, proceeds over the upper side of the coil. A ferromagnetic cap may also be used for this purpose.

Figure 4:
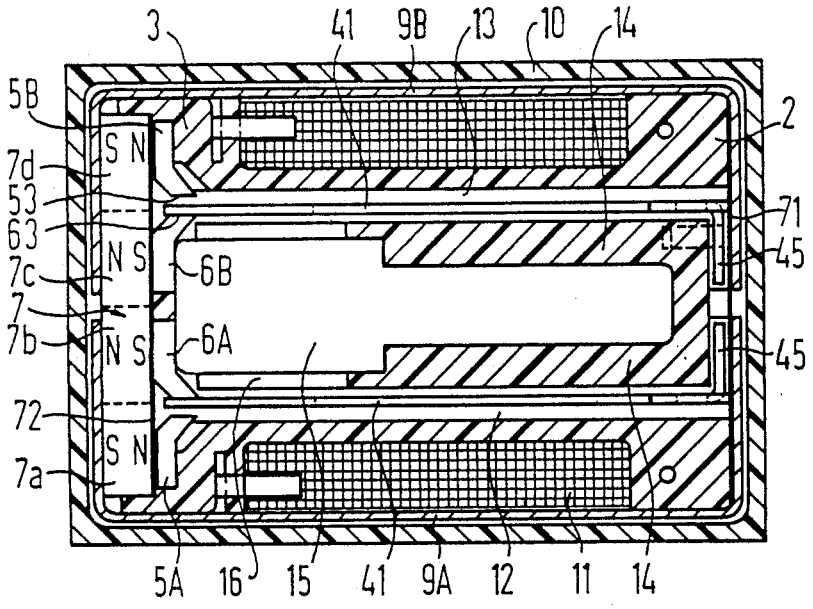
FIG. 4 is a cross section through an assembled relay of FIG. 1, illustrated partially schematically.

In FIG. 4 is shown an assembled relay which has the same structure as the relay shown in FIGS. 1 through 3 but whose individual parts are not shown in great detail but instead are shown in somewhat schematic fashion. The permanent magnet 7 is magnetized in an eight-pole fashion with polarization directions proceeding parallel to the coil axis so that every pole piece has a separate permanent magnet region allocated to it. In other words, a first permanent magnet region *7a* is allocated to the first pole piece 5A, a second permanent magnet region *7b* is allocated to the second pole piece 6A, a third permanent magnet region *7c* is allocated to the third pole piece 6B, and a fourth permanent magnet region *7d* is allocated to the fourth pole piece 5B. The magnetization of the permanent of magnet 7 is undertaken on the basis of externally applied magnetization poles. Subsequently, a balancing of each and every individual region *7a* through *7d* is undertaken so that asymmetries in the construction and in the material of the magnetic circuit are compensated on the basis of a differing magnetization of these regions. It is thereby assured that an optimally synchronous response of two contact tongues 41 is achieved This balancing is carried out after the relay is completely assembled and potted so that the permanent magnet regions *7a* through *7d* are respectively produced in the proper allocation to the pole pieces 5A through 6B and independently of the physical arrangement of the cuboid permanent magnet 7.

Figure 5:
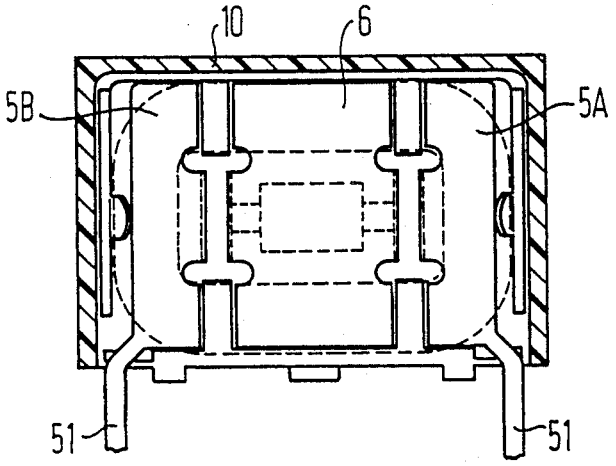
FIG. 5 is an end elevational view of a second embodiment of the relay and coil member of the invention including a modification of the pole plates in comparison to the embodiment of FIG. 1.

FIG. 5 shows an end-face view onto the coil flange member 3 in a somewhat modified embodiment of the pole pieces. Two outer pole pieces 5A and 5B are shaped and arranged essentially unmodified from the foregoing embodiment. However, the inner pole pieces are combined to form a single pole plate 6 that does not have a separate terminal itself. When the two contact tongues 41 as illustrated in FIG. 4, lie against the inner pole pieces in the direction toward the coil axis, in other words, at the common pole plate 6 of FIG. 5, then a relay having two connected, normally closed contacts is created Such relay may be used in telephone technology. In this case, naturally, the coil flange member 3 must be correspondingly shaped to enable the common pole plate 6 to be fastened thereto. In other words, the middle rib 31 of FIG. 1 must be omitted.

Thus, there is provided a relay in which synchronous switching of two contact tongues may be achieved by independent balancing of the permanent magnet regions allocated to each and every pole piece.

Although other modifications and changes may be suggested by those skilled in the art, it is the intention of the inventors to embody within the patent warranted hereon all changes and modifications as reasonably and properly come within the scope of their contribution to the art.

We claim:

1. A polarized electromagnetic relay having a connecting plane, comprising:

a coil member carrying an excitation winding, said coil member having two flanges and a through cavity extending along an axis;

two armature contact tongues lying inside said coil member substantially parallel to said axis and having principle planes lying perpendicular to the connecting plane of the relay in planes parallel to one another, said two armature contact tongues being seated at one side of said coil member in a region of a first of said two flanges;

a plurality of stationary contact elements serving as pole pieces, said cooperating contact elements being twice in number as the number of said armature contact tongues, said cooperating contact elements being opposite one another in pairs in a region of a second of said two flanges with a free end of one of said armature contact tongues between each of said pairs to form working air gaps, said pole pieces being substantially flat and lying in a common plane perpendicular to the connecting plane of the relay and to the planes of the contact tongues, said pole pieces being next to one another at said second of said two flanges;

a permanent magnet arrangement coupled to said cooperating contact elements serving as pole pieces to oppositely polarize said pole pieces of each pair, said permanent magnet arrangement of each pole piece having a separate polarization region having polarization directions parallel to said axis of said coil member, one pole of every polarization region is coupled to a pole piece; and a flux plate coupling an opposite pole facing away from said pole piece to a corresponding one of said contact tongues in a region of said first of said two flanges.

2. A polarized electromagnetic relay as claimed in claim 1, wherein said permanent magnet arrangement is a one-piece magnet having a plurality of poles being twice in number as the number of said pole pieces.

3. A polarized electromagnetic relay as claimed in claim 1, wherein said coil member has an axially oriented through contact space for each of said contact tongues, and further comprising:

a partition lying parallel to said axis and at least partially separating said through contact spaces from one another.

4. A polarized electromagnetic relay as claimed in claim 3, wherein said partition has a cavity.

5. A polarized electromagnetic relay as claimed in claim 4, further comprising: a getter tablet in said cavity in said partition.

6. A polarized electromagnetic relay as claimed in claim 4, further comprising: an auxiliary component in said cavity in said partition.

7. A polarized electromagnetic relay as claimed in claim 3, wherein said partition is formed by a getter foil.

8. A polarized electromagnetic relay as claimed in claim 1, wherein said flux plate in a common flux plate that magnetically couples all permanent magnet poles facing away from said pole pieces and all contact tongues.

9. A polarized electromagnetic relay as claimed in claim 1, wherein said flux plate couples one of said contact tongues to two of said polarization regions and further comprising: a further flux plate coupling another of said contact tongues to another two of said polarization regions, and further comprising: a further flux plate coupling another of said contact tongues to another two of said polarization regions.

10. A polarized electromagnetic relay as claimed in claim 1, further comprising:

ribs and lugs at an end face of said coil member; said pole pieces each being fixed between said ribs and lugs and said pole pieces each including contact pieces bent toward said contact tongues.

11. A polarized electromagnetic relay as claimed in claim 10, wherein outermost surfaces of said ribs and lugs of said coil member essentially align with surfaces of said pole pieces to form a substantially flat surface when assembled, and further comprising:

an insulating film between said pole pieces and said permanent magnet arrangement.

12. A polarized electromagnetic relay as claimed in claim 1, wherein said contact torques have generally T-shaped fastening tabs fastened in wedge-shaped grooves of said coil member.

13. A polarized electromagnetic relay as claimed in claim 12, wherein said fastening tubs are fastened in said grooves by gluing.

14. A polarized electromagnetic relay as claimed in claim 1, further comprising:

an insulating material in which said coil member and said permanent magnet arrangement and said flux plate is embedded.

15. A polarized electromagnetic relay as claimed in claim 1, wherein two neighboring ones of said pole pieces are joined to one another in one piece to form a pole plate without a terminal element.

16. A polarized electromagnetic relay as claimed in claim 1, wherein said two armature contact tongues are each free of an armatures element and are formed of a ferromagnetic material to operate as both a contact spring and armature.

* * * * *